US006497989B1

(12) United States Patent
Nishiyama

(10) Patent No.: US 6,497,989 B1
(45) Date of Patent: Dec. 24, 2002

(54) METHOD OF MANUFACTURING A PLANOGRAPHIC PRINTING PLATE

(75) Inventor: Yasushi Nishiyama, Shizuoka-ken (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/618,127

(22) Filed: Jul. 17, 2000

(30) Foreign Application Priority Data

Jul. 23, 1999 (JP) ..... 11-208362

(51) Int. Cl.[7] ..... G03C 1/72

(52) U.S. Cl. ..... 430/300; 430/302; 430/270.1; 430/271.1; 430/944; 101/130; 101/453; 101/454; 101/463.1

(58) Field of Search ..... 430/270.1, 271.1, 430/300, 302; 101/130, 453, 454, 463.1

(56) References Cited

U.S. PATENT DOCUMENTS

| | | | | | |
|---|---|---|---|---|---|
| 4,798,820 | A | * | 1/1989 | Yaguchi et al. | 503/207 |
| 4,853,363 | A | * | 8/1989 | Satake et al. | 503/210 |
| 4,925,827 | A | * | 5/1990 | Goto et al. | 503/207 |
| 4,929,590 | A | * | 5/1990 | Maruta et al. | 503/207 |
| 5,102,693 | A | * | 4/1992 | Motosugi et al. | 427/150 |
| 5,308,739 | A | * | 5/1994 | Uytterhoeven et al. | 430/258 |
| 5,429,907 | A | * | 7/1995 | Uytterhoeven et al. | 430/258 |
| 6,017,677 | A | * | 1/2000 | Maemoto et al. | 430/270.1 |
| 6,096,479 | A | * | 8/2000 | Kawamura et al. | 430/270.1 |
| 6,194,058 | B1 | * | 2/2001 | Isobe et al. | 428/216 |

FOREIGN PATENT DOCUMENTS

| | | |
|---|---|---|
| EP | 0 550 248 | 8/1993 |
| EP | 0 559 248 | 8/1993 |
| GB | 2179170 | 2/1987 |

* cited by examiner

*Primary Examiner*—Janet Baxter
*Assistant Examiner*—Yvette M Clarke
(74) *Attorney, Agent, or Firm*—Burns, Doane, Swecker & Mathis, LLP

(57) ABSTRACT

A planographic printing plate and a manufacturing method thereof are provided in which a deterioration in quality and performance of the planographic printing plate due to coating defects caused by foreign matter adhering to a support can be prevented. The planographic printing plate has stable quality such as uniform sensitivity with respect to writing by an infrared ray laser or the like and uniform developability. The planographic printing plate includes a support, a primer layer, and a recording layer superposed in that order. In the manufacturing method, a step of forming the primer layer, in which a coating solution for a primer layer is applied onto the support, is carried out at least two times. At this time, before a coating solution for a previous primer layer has completely dried, a coating solution for a subsequent primer layer is applied. This type of application is preferable in terms of coating uniformity and prevention of an increase in coating thickness.

17 Claims, No Drawings

METHOD OF MANUFACTURING A PLANOGRAPHIC PRINTING PLATE

BACKGROUND OF THE INVENTION

1. Field of the Invention

The present invention relates to a method of manufacturing a planographic printing plate. More particularly, the present invention relates to a method of manufacturing a planographic printing plate which exhibits excellent uniformity of the coating thicknesses of layers such as a primer layer, a recording layer, and the like, which are provided on a support.

2. Description of the Related Art

In recent years, laser technologies have developed remarkably. In particular, high output and compact solid-state lasers and semiconductor lasers emitting infrared rays of a wavelength of 760 nm to 1200 nm (hereinafter referred to as "infrared ray lasers" upon occasion) are readily available. These infrared ray lasers are very useful as light sources for recording in the direct production of printing plates from digital computer data. Accordingly, recently, the demand has increased for image recording materials which are highly sensitive to such infrared light sources for recording, i.e., image recording materials in which a photochemical reaction or the like is caused by infrared irradiation and the solubility thereof in a developer is thereby greatly changed.

An example of such image recording materials on which images can be recorded by using an infrared ray laser is a recording material which has a recording layer containing a water-insoluble and alkaline water-soluble high molecular compound and a photothermal conversion substance such as an infrared ray absorbing agent. This image recording material is a positive-type image recording material which utilizes a dissolution suppressing effect with respect to a developer containing an alkaline aqueous solution, which effect is due to the interaction between the compounds forming the recording layer.

The energy of an infrared ray is lower than that of an ultraviolet ray, which has been conventionally used as a light source for exposure. Accordingly, there is a high possibility that non-uniformity of the recording layer may adversely affect the image formation property of a planographic printing plate.

In order to improve the adhesion between the recording layer and the support and prevent the recording layer from easily coming off from the support after exposure, this type of planographic printing plate is generally formed such that a primer layer is provided on the support and the recording layer is superposed on the primer layer. In general, a coating solution for the primer layer is applied onto the support by a bar coater or an extrusion coater so as to form the primer layer. Subsequently, a coating solution for the recording layer is applied onto the primer layer in the same way as the primer layer was applied, and is dried so as to form the recording layer. In the formation of the primer layer, if foreign matter exists on the surface of the support onto which the coating solution for the primer layer is to be applied, application of the coating solution for the primer layer onto portions of the support on which the foreign matter exists is impeded, thereby resulting in local variations (locality) in the application amount (i.e., the coating thickness) of the primer layer. These variations cause local variations in the thermal reaction and the photoreaction of the recording layer, and variations in the physical strength of the planographic printing plate and in the permeability of the developer due to the non-uniformity of the coating thickness. Therefore, drawbacks arise in that the quality and performance of the planographic printing plate deteriorate.

Foreign substances on the support are generally eliminated in the washing and drying processes. However, minute particles of foreign matter may adhere to the support during the conveying thereof, and this adhesion cannot be completely prevented.

SUMMARY OF THE INVENTION

An object of the present invention is to provide a method of manufacturing a planographic printing plate which suppresses deterioration in quality and performance of the planographic printing plate due to coating defects caused by foreign matter adhering to a support, and which has stable quality such as uniform sensitivity with respect to writing by an infrared ray laser or the like and uniform developability.

The present inventors focused on the uniformity of a coating layer and achieved the present invention after learning, as a result of intensive studies, that coating defects caused by foreign matter or air bubbles can be effectively prevented by providing a plurality of primer layers.

In accordance with a first aspect of the present invention, there is provided a method of manufacturing a planographic printing plate comprising the steps of: (a) providing a support; (b) forming a plurality of primer layers on the support by applying a coating solution to the support a plurality of times; and (c) superposing a recording layer on the plurality of primer layers.

When the coating solution for the primer layer is applied plural times, a coating solution for a previous primer layer is applied, and a coating solution for a subsequent primer layer is successively applied before the coating solution for the previous primer layer has dried. This aspect is preferable in terms of the effects of the present invention.

In accordance with the manufacturing method of the present invention, in order to eliminate foreign matter adhering to the surface of the support onto which the coating solution for the primer layer is to be applied, the following processings are carried out in the application of the primer layers plural times. Namely, in a first application step or in an early stage of the steps of applying the coating solution for the primer layer, foreign matter adhering to the support is partially eliminated by application means. Thereafter, by successively applying the coating solution for the primer layer, slight local variations in the coating thickness caused by the foreign matter at the time of the first application are evened out by the time the final application step is reached, and uniform primer layers can be thereby formed. Therefore, an excellent flat surface of the primer layer can be ensured, and a uniform recording layer can be readily formed on the primer layers. As a result, problems with quality and performance of the planographic printing plate caused by a non-uniform primer layer and recording layer can be suppressed, and a planographic printing plate having stable quality can be easily manufactured.

In accordance with a second aspect of the present invention, there is provided a method of manufacturing a planographic printing plate for use in recording by an infrared ray laser, comprising the steps of: (a) providing a support; (b) forming a plurality of primer layers on the support by applying a coating solution to the support a plurality of times, wherein a total amount of material comprising the primer layers after drying is 2 to 200 $mg/m^2$; and (c) superposing a recording layer on a primer layer that was formed last.

Further, in accordance with a third aspect of the present invention, there is provided a planographic printing plate comprising: (a) a support; (b) a recording layer; and (c) a plurality of primer layers disposed between the support and the recording layer, wherein the primer layers comprise coatings of a coating solution.

DESCRIPTION OF THE PREFERRED EMBODIMENTS

Hereinafter, the structure of a planographic printing plate and a manufacturing method thereof in accordance with the present invention will be described in detail. The method of manufacturing a planographic printing plate in accordance with the present invention is characterized in that a plurality of primer layers are provided on a support.

First, a support of the planographic printing plate will be described. The support of the planographic printing plate in accordance with the present invention is not particularly limited as long as it is a dimensionally stable plate-like material. Examples of the support include paper, paper laminated with plastic (such as polyethylene, polypropylene, and polystyrene), metal plates (such as aluminum, zinc, and copper), plastic films (such as cellulose diacetate, cellulose triacetate, cellulose propionate, cellulose butyrate, cellulose acetate/butyrate, cellulose nitrate, polyethylene terephthalate, polyethylene, polystyrene, polypropylene, polycarbonate, and polyvinyl acetal), and paper or plastic films laminated or deposited with the above-mentioned metals.

A polyester film or an aluminum plate is preferable as the support used in the present invention. In particular, an aluminum plate is preferable since it has good dimensional stability and can be provided at a relatively low cost. Examples of preferable aluminum plates include pure aluminum plates and alloy plates containing aluminum as the main component and trace quantities of a different element. Furthermore, plastic films to which aluminum is laminated or deposited can also be used. Examples of different elements included in an aluminum alloy are silicon, iron, manganese, copper, magnesium, chrome, zinc, bismuth, nickel, and titanium. The total amount of the different elements in the alloy is preferably 10% by weight or less. Pure aluminum is particularly preferable in the present invention. However, since production of a completely pure aluminum is difficult in terms of refining technology, an aluminum alloy containing trace quantities of different elements can be used. The composition of the aluminum plate used in the present invention is not specifically defined, and a known aluminum plate can also be suitably used.

The thickness of the aluminum plate used in the present invention is about 0.1 to 0.6 mm, preferably 0.15 to 0.4 mm, and more preferably 0.2 to 0.3 mm.

Although an aluminum plate with the surface thereof having been roughened is used, prior to roughening, a degreasing treatment with a surfactant, an organic solvent, an aqueous alkaline solution or the like can be conducted for removing the rolling oil on the surface as needed.

The surface roughening treatment of the aluminum plate can be implemented by using various methods, such as a mechanically roughening method, an electrochemically roughening method in which the plate surface is dissolved, and a chemically roughening method in which the plate surface is selectively dissolved. As a mechanical method, known methods such as a ball abrasion method, brush abrasion method, a blast abrasion method, and a buff abrasion method can be used. As an electrochemically roughening method, a method in which an alternating current or direct current is applied to a plate in an electrolytic solution containing a hydrochloric acid or nitric acid can be used. Further, a method combining both of the mechanical method and the electrochemically roughening method as disclosed in Japanese Patent Application Laid-Open (hereinafter abbreviated as "JP-A") No. 54-63902 can also be used.

An aluminum plate to which a surface roughening treatment has been applied may be subjected to an alkaline etching treatment and a neutralizing treatment, if necessary, followed by an anodizing treatment so as to improve the water retention property and the abrasion resistance property of the surface, if desired. As the electrolyte used in the anodizing treatment of the aluminum plate, various electrolytes which form a porous oxide film can be used. In general, sulfuric acid, phosphoric acid, oxalic acid, chromic acid, or a mixture thereof are used. The concentration of the electrolyte is suitably determined according to the type of electrolyte which is used.

Conditions of anodizing are determined according to the type of electrolyte used, and thus cannot be universally specified. However, in general, the following conditions are appropriate: concentration of electrolyte in the solution: 1 to 80% by weight; solution temperature: 5 to 70 ° C.; current density: 5 to 60 A/dm$^2$; voltage: 1 to 100 V; and period of time over which electrolysis is carried out: 10 seconds to 5 minutes. An amount of anodized film less than 1.0 g/m$^2$ results in insufficient plate wear, scratches being easily produced in non-image portions of the planographic printing plate, and a tendency toward so-called "tinting" which occurs by ink adhering to the scratches.

After the anodizing treatment, a hydrophilic treatment is applied to the aluminum surface, if necessary. Examples of hydrophilic treatments include an alkaline metal silicate (such as an aqueous solution of sodium silicate) method as disclosed in U.S. Pat. Nos. 2,714,066, 3,181,461, 3,280,734 and 3,902,734. In this method, the support is immersed in, or subjected to electrolysis with, an aqueous solution of sodium silicate. Other examples include a method of treating with potassium fluorozirconate disclosed in Japanese Patent Application Publication (hereinafter abbreviated as "JP-B") No. 36-22063 and methods of treating with polyvinyl phosphonate disclosed in U.S. Pat. Nos. 3,276,868, 4,153,461, and 4,689,272.

In the present invention, at least two primer layers are provided between a support and a recording layer in a superposed manner. Various organic compounds can be used as a primer layer component. Examples include carboxymethyl cellulose; dextrin; gum arabic; phosphonic acids having an amino group such as 2-amino ethyl phosphonic acid; organic phosphonic acids which may have a substituent, such as phenyl phosphonic acid, naphthyl phosphonic acid, alkyl phosphonic acid, glycero phosphonic acid, methylene diphosphonic acid, and ethylene diphosphonic acid; organic phosphoric acids which may have a substituent, such as phenyl phosphoric acid, naphthyl phosphoric acid, alkyl phosphoric acid, and glycero phosphoric acid; organic phosphinic acids which may have a substituent, such as phenyl phosphinic acid, naphthyl phosphinic acid, alkyl phosphinic acid, and glycero phosphinic acid; amino acids such as glycine and β-alanine; and hydrochlorides of amine having a hydroxy group, such as hydrochloride of triethanol amine. The primer layer component is selected from the organic compounds above, and a combination of two or more primer layer components can be used.

The primer layer can be formed by a method of applying, onto the aluminum plate, a coating solution for the primer layer in which the aforementioned organic compound is dissolved in water or in an organic solvent such as methanol, ethanol, methyl ethyl ketone, or a mixed solvent thereof, and the applied coating solution is dried.

As the coating solution for the primer layer which is used in this method, a solution having a concentration of the above-mentioned organic compound of 0.005 to 10% by weight can be used. The concentration of the solution may be suitably adjusted in accordance with the purpose for which the solution is to be used. The pH value of the coating solution for the primer layer can be adjusted in the range of 1 to 12 by using basic substances such as ammonia, triethylamine or potassium hydroxide, or acidic substances such as hydrochloric acid or phosphoric acid. Further, a yellow dye may be added to the coating solution to improve the color tone reproduction property of the planographic printing plate.

As a method of application, various methods can be used, such as bar coater application, rotation application, spray application, curtain application, air knife application, blade application, roll application, and dip application.

When a plurality of primer layers are provided, the applied amount of each of the primer layers after drying is suitably 0.5 to 200 $mg/m^2$, and preferably 1 to 100 $mg/m^2$. Further, the total applied amount of the plurality of primer layers is suitably 2 to 200 $mg/m^2$, and preferably 5 to 100 $mg/m^2$. If the total applied amount is less than 2 $mg/m^2$ or more than 200 $mg/m^2$, sufficient wear resistance of the plate cannot be obtained.

When the plurality of primer layers are provided, it is preferable that, before the coating solution for the primer layer which has been previously applied dries, the coating solution for the primer layer is successively applied onto the previously applied primer layer. Namely, if the coating solution is successively applied onto the previously applied coating solution before the surface of the previously applied coating solution has completely dried and hardened, since the surface of the previously formed primer layer is soft and can be deformed against stress, filling the coating solution into gaps formed by foreign matter, and alleviating the irregularity of the surface are more easily carried out as compared with a case in which filling and alleviating are carried out after the surface of the previously formed primer layer has hardened. Furthermore, if a primer layer is formed on a first primer layer after the first primer layer has completely dried, the total coating thickness of the primer layers tend to be thick. This is not preferable in terms of handling.

The timing at which an adjacent primer layer is successively formed after the application of the coating solution for the previous primer layer can be suitably determined depending on the composition of the effective components of the coating solution, the characteristics of the solvent used, atmosphere, temperature, humidity, and the like. However, as long as the composition is within the above-described range, the interval between the application of the previous primer layer and the successive application is preferably 0.1 to 15 seconds, and more preferably 0.20 to 12 seconds.

Whether the coating layer has dried or not can be determined by means such as visual observation, touching a model coating layer, measurement of changes in the weight of the model coating layer, and measurement of the density of gas of the solvent, which gas is generated by drying the coating layer. Therefore, the time required until the coating layer completely dries can be measured in advance for each composition of the coating solutions for the primer layers.

The compositions of the coating solutions used to form the plurality of primer layers do not necessarily have to be identical. The coating solutions can be suitably used in combination in accordance with the desired functions of the primer layers.

In the manufacturing method of the present invention, application of the coating solution for the primer layer is carried out plural times. As for the number of times, the application of the coating solution is preferably carried out two to four times. Even if the application is carried out five times or more, further improvement in the effect of the uniformity of the coating layers is not recognized. On the contrary, the coating thicknesses of the primer layers become large, and other problems may arise.

After the uniform primer layers have been formed in the above-described manner, a recording layer is superposed on the uppermost primer layer, and a planographic printing plate is thereby obtained.

As for the material forming the recording layer of the planographic printing plate according to the present invention, a water-insoluble and alkaline water-soluble polymer, i.e., a homopolymer having an acidic group at a main chain and/or a side chain, a copolymer of these polymers, or a mixture thereof is used as a binder polymer. Accordingly, the planographic printing plate in accordance with the present invention can be developed with an alkali developer.

Among water-insoluble and alkaline water-soluble polymers, the polymers having the following acidic groups (1) through (6) at the main chains and/or the side chains of the polymers are preferable in terms of the solubility in an alkali developer and development of the dissolution suppressing ability:

(1) a phenol group (—Ar—OH);

(2) a sulfonamide group (—$SO_2$ NH—R);

(3) a substituted sulfonamide group (hereinafter referred to as an "active imido group") [—$SO_2$ NHCOR, —SO2 $NHSO_2$ R, or —$CONHSO_2$ R];

(4) a carboxylic acid group (—$CO_2$ H);

(5) a sulfonic acid group (—$SO_3$ H); and (6) a phosphoric acid group (—$OPO_3$ $H_2$).

In the acidic groups (1) through (6), Ar represents a bivalent aryl linking group which may have a substituent, and R represents a hydrocarbon radical which may have a substituent.

Among the alkaline water-soluble polymers having an acidic group selected from the acidic groups (1) through (6), the alkaline water-soluble polymer having (1) a phenol group, (2) a sulfonamide group, or (3) an active imido group is preferable. In particular, the alkaline water-soluble polymer having (1) a phenol group or (2) a sulfonamide group is most preferable in terms of sufficiently ensuring the solubility in an alkali developer, development latitude, and coating strength.

Examples of the alkaline water-soluble polymer having an acidic group selected from the above acidic groups (1) through (6) include the following polymers (1) to (6).

(1) Examples of the alkaline water-soluble polymer having a phenol group include novolak resins such as a condensation polymer of phenol and formaldehyde, a condensation polymer of m-cresol and formaldehyde, a condensation polymer of m-/p-mixed cresol and formaldehyde, and a condensation polymer of phenol, cresol (any of m-, p-, and m-/p-mixed cresol) and formaldehyde; and a condensation polymer of pyrogallol and acetone. Further, a copolymer of compounds each having a phenol group at a side chain thereof can also be used.

(2) Examples of the alkaline water-soluble polymer having a sulfonamide group include polymers whose main component is the minimum structural unit derived from a compound having a sulfonamide group. An example of the above-mentioned compound is a compound having, in a molecule, one or more sulfonamide groups in which at least one hydrogen atom is bonded to a nitrogen atom, and one or more unsaturated groups which can be polymerized. Preferred is a low molecular compound having, in a molecule, an acryloyl group, an allyl group or a vinyloxy group, and a substituted or mono-substituted aminosulfonyl group or a substituted sulfonylimino group.

(3) Examples of the alkaline water-soluble polymer having an active imido group include polymers whose main component is the minimum unit derived from a compound having an active imido group. An example of the above-mentioned compound is a compound having, in a molecule, one or more active imido groups represented by the following formula and one or more unsaturated groups which can be polymerized.

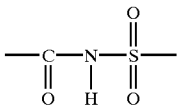

Specifically, N-(p-toluenesulfonyl)methacrylamide, N-(p-toluenesulfonyl)acrylamide, or the like can be preferably used.

(4) Examples of the alkaline water-soluble polymer having a carboxylic acid group are polymers whose main component is the minimum structural unit derived from a compound having, in a molecule, one or more carboxylic acid groups and one or more unsaturated groups which can be polymerized.

(5) Examples of the alkaline water-soluble polymer having a sulfonic acid group include polymers whose main component is the minimum structural unit derived from a compound having, in a molecule, one or more sulfonic acid groups and one or more unsaturated groups which can be polymerized.

(6) Examples of the alkaline water-soluble polymer having a phosphoric acid group include polymers whose main component is the minimum structural unit derived from a compound having, in a molecule, one or more phoshoric acid groups and one or more unsaturated groups which can be polymerized.

Among the above-described alkaline water-soluble polymers, the alkaline water-soluble polymer (1) having a phenol hydroxyl group is particularly preferable since strong interactions can be obtained between the polyfunctional amine compounds.

The minimum structural unit which has an acidic group selected from the acidic groups (1) to (6) and forms the alkaline water-soluble polymer used for the recording layer of the planographic printing plate according to the present invention does not have to be only one type. Two or more types of the minimum structural units having the same acidic group, or a copolymer of two or more types of the minimum structural units having different acidic groups can also be used.

Conventionally known copolymerization methods such as graft copolymerization, block copolymerization and random copolymerization can be used as the copolymerization method.

The copolymer contains preferably 10 mol % or more, and more preferably 20 mol % or more of the compound to be copolymerized which has an acidic group selected from the acidic groups (1) through (6). If the content of the compound is less than 10 mol %, there is a tendency that development latitude cannot be sufficiently improved.

Only one type of the alkaline water-soluble polymer may be used, or two or more types of the alkaline water-soluble polymers may be used in combination. The alkaline water-soluble polymer is used in a range of preferably 30 to 99% by weight, more preferably 40 to 95% by weight, and particularly 50 to, 90% by weight, based on the total solids of the material forming the recording layer in the planographic printing plate.

When the used amount of the alkaline water-soluble polymer is less than 30% by weight, durability of the recording layer tends to deteriorate. On the other hand, when the used amount of the polymer exceeds 99% by weight, sensitivity and durability tend to deteriorate. Therefore, these amounts are not preferable.

An example of other material forming the recording layer of the planographic printing plate in accordance with the present invention is an infrared ray absorbing agent. Since the positive action (namely, development is suppressed in unexposed portions, and development is suppressed little or not at all in exposed portions) must occur between the structural units of the polymer, an infrared absorbing agent having an onium salt type structure is preferable. Specifically, dyes such as cyanine pigments and pyrylium salts can be preferably used.

Moreover, the anionic infrared ray absorbing agent disclosed in Japanese Application No. 10-79912 can be preferably used as well. An anionic infrared ray absorbing agent refers to an agent which has no cationic structure but has an anionic structure in the nuclei of the pigment, which substantially absorbs infrared rays. For example, an anionic metal complex (c1), anionic carbon black (c2), anionic phthalocyanine (c3), and a compound (c4) represented by the following general formula (6) are examples of anionic infrared ray absorbing agents. Counter cations of these anionic infrared ray absorbing agents are monovalent cations containing a proton or polyvalent cations.

General Formula (6)

$$\{G_a^- — M — G_b\}_m \; X^{m+}$$

In general formula (6), $G_a$ represents an anionic substituent, and $G_b$ represents a neutral substituent. $X^{m+}$represents a cation having a valence of 1 to m and containing a proton, and m represents an integer of 1 to 6.

These infrared ray absorbing agents can be added to the material forming the recording layer in the planographic printing plate in an amount of 0.01 to 50% by weight, preferably 0.1 to 10% by weight, and particularly preferably 0.5 to 10% by weight, with respect to the total solids of the planographic printing plate. When the amount of the dyes is less than 0.01% by weight, sensitivity is decreased. When the amount to be added exceeds 50% by weight, stains are formed in non-image portions at the time of printing.

The material forming the recording layer of the planographic printing plate may also comprise other dyes, pigments or the like for the purpose of further improving sensitivity and development latitude. For example, onium salts, aromatic sulfone compounds, and esters of aromatic sulfonic acids which are other than those described above act as thermal decomposition substances. Therefore, addition of such substances is preferable in terms of improving the ability to prevent the dissolution of image portions in a developer.

Further, a dye having high absorption in the visible light region can be used as the coloring agent of an image. Preferable dyes include oil soluble dyes and basic dyes.

Specifically, it is preferable to add dyes such as OIL YELLOW #101, OIL YELLOW #103 and OIL PINK #312 so that the image portions and non-image portions can be clearly distinguished after an image is formed. The amount to be added is preferably 0.01 to 10% by weight based on the total solids of the material forming the recording layer in the planographic printing plate.

Moreover, cyclic acid anhydrides, phenols, and organic acids can also be added to further improve sensitivity. In order to carry out even more stable processings under various development conditions, nonionic surfactants disclosed in JP-A Nos. 62-251740 and 3-208514, and ampholytic surfactants disclosed in JP-A Nos. 59-121044 and 4-13149 can be added to the planographic printing plate of the present invention.

Further, a plasticizer for imparting flexibility to a coating may be added to the material forming the recording layer as occasion demands. For example, polyethyleneglycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and an oligomer or polymer of acrylic acid or methacrylic acid can be preferably used as a plasticizer.

A surfactant for improving application properties, such as a fluorine-based surfactant disclosed in JP-A No. 62-170950, can be added to the material forming the recording layer in the planographic printing plate of the present invention. The amount to be added is preferably 0.01 to 1% by weight, and more preferably 0.05 to 0.5% by weight of the overall planographic printing material.

The recording layer is formed by dissolving in a solvent the material which is comprised of the above-mentioned components and forms the recording layer and applying the resultant coating solution for the recording layer onto the primer layers which have been uniformly formed in the above-described manner. Solvents used herein include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethyl acetamide, N,N-dimethyl formamide, tetramethyl urea, N-methyl pyrrolidone, dimethyl sulfoxide, sulfolane, γ-butyrolactone, toluene, and water. These solvents are used alone or as a mixture. The concentration of the above-mentioned components (total solids including additives) is preferably 1 to 50% by weight in the solvent. The amount (solids) applied onto the support obtained after application and drying is determined according to the purpose for which the printing plate is to be used. However, when the printing plate is used as a photosensitive printing plate, in general, the applied amount (solids) of the above-mentioned components is preferably 0.5 to 5.0 $g/m^2$.

As the application method, various methods can be used such as bar coater application, rotation application, spray application, curtain application, dip application, air knife application, blade application, and roll application. As the application amount decreases, the apparent sensitivity increases, but the film characteristics of the recording layer become poor. This applied layer serves as the recording layer in the planographic printing plate.

The planographic printing plate produced as described above is usually subjected to image-exposure and developing processing such that an image is formed. Examples of the light source for an active light beam used in the image-exposure include a mercury-arc lamp, a metal halide lamp, a xenon lamp, a chemical lamp, and a carbon arc lamp. Example of radioactive rays include electron beams, X rays, ion beams, and far infrared rays. Further, g-rays, i-rays, deep UV rays, and high-density energy beams (laser beams) are also used. Examples of the laser beam include a helium-neon laser, an argon laser, a krypton laser, a helium-cadmium laser, a KrF excimer laser, a solid state laser, and a semiconductor laser. In the present invention, a light source emitting light of wavelengths in the near infrared region to the infrared region is preferable. Particularly preferable are a solid state laser and a semiconductor laser.

Conventionally known aqueous alkaline solutions can be used as the developer and replenishing solution. Examples include inorganic alkali salts such as sodium silicate, potassium silicate, sodium tertiary phosphate, potassium tertiary phosphate, ammonium tertiary phosphate, sodium secondary phosphate, potassium secondary phosphate, ammonium secondary phosphate, sodium carbonate, potassium carbonate, ammonium carbonate, sodium hydrogencarbonate, potassium hydrogencarbonate, ammonium hydrogencarbonate, sodium borate, potassium borate, ammonium borate, sodium hydroxide, ammonium hydroxide, potassium hydroxide, and lithium hydroxide. Further, organic alkaline agents such as the following can also be used: monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, pyridine, and the like.

These alkaline agents may be used alone, or a combination of two or more may be used.

Particularly preferable developers among these alkaline agents are an aqueous solution of silicate, such as sodium silicate or potassium silicate. This is because the developability can be adjusted by the ratio and concentration of silicon dioxide $SiO_2$ which is a component of silicate and an alkali metal oxide $M_2O$ (M represents an alkali metal). For example, alkali metal silicates such as those disclosed in JP-A No. 54-62004 and JP-B No. 57-7427 can be effectively used.

Furthermore, it is known that, in a case in which an automatic developing machine is used for developing, by adding to the developer an aqueous solution (replenishing solution) whose alkalinity is higher than that of the developer, a large amount of planographic printing plates can be developed without changing the developer in the developing tank for a long time. This replenishing method is also preferably used in the present invention. Various types of surfactants and organic solvents can be added to the developer or the replenishing solution as needed for promoting or suppressing the developability, and improving the dispersion of scum and the affinity of the planographic printing plate image portions to ink. Examples of preferable surfactants include anionic surfactants, cationic surfactants, nonionic surfactants, and ampholytic surfactants. Further, a reducing agent such as hydroquinone, resorcin, a sodium or potassium salt of an inorganic acid such as sulfurous acid or sulfurous hydrogen acid; an organic carboxylic acid; an antifoamer; and a hard-water softener may also be added to the developer and the replenishing solution as needed.

Planographic printing plates developed by using the above-mentioned developers and replenishing solutions are subjected to a post-treatment with a rinsing solution containing water, a surfactant, or the like, and a desensitizing solution containing gum arabic or a starch derivative. In a case in which the planographic printing plate of the present invention is used, these treatments can be used in combination as a post-treatment.

Recently, an automatic developing machine for planographic printing plates has been widely used in plate making and printing industries in order to streamline and standardize the plate making operation. The planographic printing plate in accordance with the present invention can also be processed by the automatic developing machine. In general, this automatic developing machine comprises a developing section and a post-treatment section, and each section comprises a device for conveying a printing plate, processsing solution tanks, and spraying devices. The developing processing is carried out by spraying a processing solution, which is pumped up by a pump, from a spray nozzle onto the printing plate after exposure while the printing plate is horizontally conveyed. In addition, a processing method has also been known recently in which an exposed printing plate is subjected to processing by being immersed in a processing tank filled with a processing solution while the printing plate is conveyed in the solution by guide rollers. In such automatic processing, a replenishing solution can be replenished for each treatment in accordance with the amount of printing plates to be developed, the work time, and the like. Further, a so-called disposable processing method, in which a substantially unused processing solution is utilized for treatment, can be applied as well.

In a case in which a planographic printing plate obtained by image exposure, development, washing with water, and/or rinsing and/or gum coating has unnecessary image portions (for example, traces of film edges of the original film or the like), such unnecessary image portions can be removed. It is preferred that removal is carried out by applying a removing solution such as that described in JP-B No. 2-13293 onto the unnecessary image portions, allowing the printing plate to stand for a given period of time, and then washing the printing plate with water. Also, the method described in JP-A No. 59-174842 may be used in which unnecessary image portions are irradiated with an active light beam guided through an optical fiber and are developed thereafter.

If desired, a desensitizing gum may be applied to a planographic printing plate which has been subjected to the above-described treatments, and thereafter, the printing plate may be used in a printing process. The plate may be subjected to a burning treatment for the purpose of improving plate run length. In a case in which a burning treatment is applied to a planographic printing plate, prior to the burning treatment, it is preferable to treat the plate with a burning conditioner such as those disclosed in JP-B Nos. 61-2518 and 55-28062, and JP-A Nos. 62-31859 and 61-159655. Examples of methods of treating the planographic printing plate with a surface-adjusting solution include a method of applying the surface-adjusting solution onto the planographic printing plate with a sponge or an absorbent cotton soaked with the surface-adjusting solution, a method of immersing the planographic printing plate in a tray filled with the solution to coat the plate with the solution, and a method of applying the surface-adjusting solution onto the printing plate by an automatic coater. It is more preferable if the applied amount of the surface-adjusting solution is made uniform over the entire surface with a squeegee or a squeegee roller after application. In general, an appropriate amount of the surface-adjusting solution to be applied is 0.03 to 0.8 g/m$^2$ (dry weight).

After the planographic printing plate treated with the surface-adjusting solution is dried, the planographic printing plate may be heated to a high temperature by using a burning processor (such as burning processor BP-1300 commercially available from Fuji Photo Film Co., Ltd.), if necessary. The heating temperature and the heating time depend on the type of components forming the image. However, a heating temperature of 180 to 300° C. and heating time of 1 to 20 minutes are preferable.

If necessary, the planographic printing plate subjected to the burning treatment can further be appropriately subjected to conventional treatments such as washing with water and gum coating. However, in a case in which a surface-adjusting solution containing a water-soluble polymer compound is used, a desensitizing treatment such as gum coating can be omitted.

The planographic printing plate obtained by such treatment is loaded in an offset printing machine and is used for printing of sheets or the like.

EXAMPLES

The present invention will now be described in detail by way of Examples. However, the scope of the present invention is not limited to these Examples.

Production of Support

An aluminum plate (material quality: 1050) having a thickness of 0.3 mm was washed with trichloroethylene to remove grease, and then the surface was made coarse with a nylon brush and a suspension of a 400 mesh pumice in water, and then was washed well with water. The plate was dipped into a 25% sodium hydroxide aqueous solution at 45° C. for 9 seconds to be etched. After being washed with water, the plate was dipped into 20% nitric acid for 20 seconds and then washed with water. The etched amount of the coarse surface was about 3 g/m$^2$. By direct current-anodic oxidization at a currency density of 15 A/dm$^2$ using 7% sulfuric acid as an electrolytic solution, a direct current anodically oxidized film of 3 g/dm$^2$ was formed on the plate. Thereafter, the plate was washed with water and dried, and a support was thereby obtained.

Examples 1 through 13

Next, the following coating solutions A and B for the primer layers were prepared and applied onto the support under the conditions given in Table 1 below. The final coating was dried at 90° C. for one minute, and a primer layer was thereby formed on the support. The applied amount of the primer layer (the total applied amount of primer layers in a case in which a plurality of primer layers are formed) after drying is given in Table 1 below.

| Composition of coating solution A for the primer layer | |
|---|---|
| β-alanine | 0.50 g |
| Methanol | 95 g |
| Water | 5.0 g |
| **Composition of coating solution B for the primer layer** | |
| β-alanine | 0.1 g |
| Phenyl phosphonic acid | 0.05 g |
| Methanol | 40 g |
| Pure water | 60 g |

Synthesis of Water-insoluble and Alkaline Water-soluble Polymer

Synthesis of copolymer P

Into a 500 ml three neck flask equipped with a stirrer, a condenser and a dropping funnel, 31.0 g (0.36 mole) of methacrylic acid, 39.1 g (0.36 mole) of chloroethyl formate and 200 ml of acetonitrile were introduced and stirred while being cooled in an ice bath. Through the dropping funnel, 36.4 g (0.36 mole) of triethylamine was added dropwise to the resulting mixture over about one hour. After this addition, the ice bath was removed, and the mixture was stirred at room temperature for 30 minutes.

To this reaction mixture, 51.7 g (0.30 mole) of p-aminobenzenesulfonamide was added, and then the mixture was stirred for one hour while being heated to 70° C. in a hot water bath. After the reaction was finished, this mixture was added to 1 liter of water while the water was stirred, and then the resulting mixture was stirred for 30 minutes. This mixture was filtered to remove the precipitates. 500 ml of water was added to the precipitates to obtain a slurry, and then this slurry was filtered. The obtained solid was dried to yield a white solid of N-(p-aminosulfonylphenyl) methacrylamide (yield: 46.9 g).

Next, to 100 ml three neck flask equipped with a stirrer, a condenser, and a dropping funnel, 5.04 g (0.02 mole) of N-(p-aminosulfonylphenyl)methacrylamide, 2.05 g (0.0180 mole) of ethyl methacrylate, 1.11 g (0.021 mole) of acrylonitrile, and 20 g of N,N-dimethylacetamide were introduced, and then the resulting mixture was stirred while being heated to 65° C. in a hot water bath. To this mixture, 0.15 g of 2,2-azobis(2,4-dimethylvaleronitrile) (trade name: V-65, produced by Wako Junyaku K. K.) was added as a radical polymerization initiator, and then the mixture was stirred under a nitrogen gas flow for 2 hours while a temperature of 65° C. was maintained. To this reaction mixture, a mixture of 5.04 g of N-(p-aminosulfonylphenyl) methacrylamide, 2.05 g of ethyl methacrylate, 1.11 g of acrylonitrile, 20 g of N,N-dimethylacetamide, and 0.15 g of the above V-65 was added dropwise through the dropping funnel over 2 hours. After this dropwise addition was finished, the resultant mixture was stirred at 65° C. for 2 hours. After the reaction was finished, 40 g of methanol was added to the mixture, and the mixture was cooled. The obtained mixture was introduced into 2 liters of water while the water was stirred, and then the resultant mixture was stirred for 30 minutes. Thereafter, the precipitates were removed by filtration and dried to obtain 15 g of a white solid copolymer P.

The weight average molecular weight (polystyrene reference) of the resultant copolymer P was measured by gel permeation chromatography and found to be 53000.

Formation of Recording Layer

A coating solution for a recording layer having the following composition was prepared. Composition of coating solution for recording layer

| | |
|---|---|
| Copolymer P | 0.75 g |
| m, p-cresol novolak (m/p ratio = 6/4, a weight average molecular weight of 3500, containing 0.5% by weight of unreacted cresol) | 0.25 g |
| Infrared ray absorbing agent (1R5-1 of the following formula) | 0.20 g |
| Tetrahydrophthalic anhydride | 0.03 g |
| Dye prepared by replacing the counter anion of VICTORIA PURE BLUE BOH with an anion of 1-naphthalenesulfonic acid | 0.015 g |
| Fluorine-containing surfactant (trade name: MEGAFAC F-177, produced by Dainippon Ink & Chemicals, Inc.) | 0.05 g |
| γ-butyrolactone | 10.0 g |
| Methyl ethyl ketone | 10.0 g |
| 1 methoxy-2-propanol | 1.0 g |

[IR5-1]

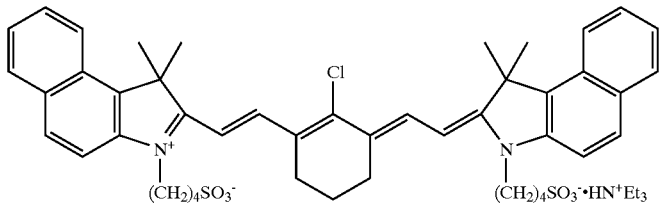

Onto the primer layer which has been obtained on the support in the above-described manner, the coating solution for the recording layer was applied such that the applied amount after drying was 18 mg/m$^2$. The recording layer was dried, and a planographic printing plate was thereby obtained.

Comparative Example 1

A planographic printing plate was produced in the same way as in Example 1 except that, at the time of forming the primer layer, only the coating solution A for the primer layer was used and applied onto the support such that the applied amount after drying was 18.3 mg/m$^2$, and the coating was dried at 90° C. for one minute to form a single primer layer on the support.

TABLE 1

| | First coating solution | Second coating solution | Third coating solution | Fourth coating solution | Fifth coating solution | Time between first coating and second coating (seconds) | Applied amount ($mg/m^2$) | Number of minute defects caused by remaining coating |
|---|---|---|---|---|---|---|---|---|
| Comparative Example 1 | None | Coating solution A | — | — | — | — | 18.3 | 11 |
| Example 1 | Coating solution A | Coating solution B | — | — | — | 0.68 | 18.6 | 2 |
| Example 2 | Coating solution B | Coating solution A | — | — | — | 0.68 | 18.8 | 3 |
| Example 3 | Coating solution A | Coating solution A | — | — | — | 0.20 | 20.7 | 2 |
| Example 4 | Coating solution A | Coating solution A | — | — | — | 0.12 | 18.6 | 2 |
| Example 5 | Coating solution A | Coating solution A | — | — | — | 0.20 | 17.8 | 3 |
| Example 6 | Coating solution A | Coating solution A | — | — | — | 0.68 | 20.7 | 2 |
| Example 7 | Coating solution A | Coating solution A | — | — | — | 1.72 | 20.8 | 2 |
| Example 8 | Coating solution A | Coating solution A | — | — | — | 12.8 | 19.2 | 3 |
| Example 9 | Coating solution A | Coating solution A | — | — | — | 20.0 | 21.0 | 3 |
| Example 10 | Coating solution A | Coating solution A | Coating solution A | — | — | 0.68 (between first coating and second coating)<br>0.68 (between second coating and third coating) | 23.6 | 2 |
| Example 11 | Coating solution A | Coating solution A | Coating solution A | Coating solution A | — | 0.68 (between first coating and second coating)<br>0.68 (between second coating and third coating)<br>0.68 (between third coating and fourth coating) | 24.0 | 3 |
| Example 12 | Coating solution A | Coating solution A | — | — | — | 26.0 | 28.2 | 3 |
| Example 13 | Coating solution A | Coating solution A | Coating solution A | Coating solution A | Coating solution A | 0.68 (between first coating and second coating)<br>0.68 (between second coating and third coating)<br>0.68 (between third coating and fourth coating)<br>0.68 (between fourth coating and fifth coating) | 26.2 | 2 |

Performance of the respective planographic printing plates in Examples 1 through 13 and Comparative Example 1 which were produced as described above was evaluated based on the following criteria.

Evaluation of Image Formation Property and Developability

The planographic printing plates in Examples 1 through 13 and Comparative Example 1 were exposed by using a semiconductor laser having a wavelength of 840 nm. After exposure, the planographic printing plates were subjected to development by using an automatic developing machine (PS PROCESSOR 900VR manufactured by Fuji Photo Film Co., Ltd.) with a developer of the following composition supplied therein. Composition of developer

| | |
|---|---|
| 1K potassium silicate | 3.0 parts by weight |
| Potassium hydroxide | 1.5 parts by weight |
| $C_{12}H_{25}—C_6H_4—O—C_6H_4—SO_3Na$ | 0.3 parts by weight |
| Water | 95.2 parts by weight |

The number of minute defects caused by coating remaining on non-image portions of the respective planographic printing plates which have been obtained by development with the developer was measured by visual observation. The smaller the number of defects, the fewer the coating defects of the planographic printing plate.

From the above results, it was found that the planographic printing plates in Examples 1 through 13 had a smaller number of defects caused by remaining coating and were more excellent in the developability as compared with the planographic printing plate in Comparative Example 1 in which only one primer layer was provided.

More specifically, in the planographic printing plates in Examples 1 through 9 in which, before a coating solution for a previous primer layer dried, a coating solution for a subsequent primer layer was successively applied onto the previous primer layer, excellent uniformity of the coating thickness was ensured although the total applied amount of the primer layers was small. This tendency was also seen in the planographic printing plates in Examples 10 and 11, in which three to four primer layers were formed. As for the planographic printing plate in Example 12 in which a second primer layer was formed on a first layer after the first layer dried completely, and in the planographic printing plate in Example 13 in which five primer layers were formed, similar effects were observed, but a tendency was seen that the applied amount of the primer layers increased.

In accordance with the method of manufacturing a planographic printing plate of the present invention, it is possible to easily manufacture a planographic printing plate which can suppress deterioration in quality and performance of a planographic printing plate due to coating defects caused by foreign matter adhering to a support, and which has stable quality such as uniform sensitivity with respect to writing by an infrared ray laser or the like and uniform developability.

What is claimed is:

1. A method of manufacturing a planographic printing plate comprising the steps of:

(a) providing a support;

(b) forming a plurality of primer layers on the support by applying a coating solution to the support a plurality of times which results in a total amount of material for at least two successive primer layers after drying of 2 to 200 $mg/m^2$; and (c) superposing a recording layer on said plurality of primer layers, wherein the step of forming a plurality of primer layers includes applying the coating solution once to form one primer layer, and applying the coating solution again, to form another primer layer, wherein an interval of time between successive applications of the coating solution is 0.1 to 15 seconds.

2. The method of claim 1, wherein the step of forming a plurality of primer layers includes applying the coating solution once to form one primer layer, and applying the coating solution again, before the coating solution previously applied has completely dried, to form another primer layer.

3. The method of claim 1, wherein the step of forming a plurality of primer layers includes applying the coating solution once to form one primer layer, and applying the coating solution again, to form another primer layer, wherein an interval of time between successive applications of the coating solution is 0.20 to 12 seconds.

4. The method of claim 1, wherein in the step of forming a plurality of primer layers, the coating solution is applied from two to four times.

5. The method of claim 1, wherein in the step of forming a plurality of primer layers, a coating solution has a composition substantially identical to a composition of at least one other coating solution.

6. The method of claim 1, wherein in the step of forming a plurality of primer layers, a coating solution has a composition different from a composition of at least one other coating solution.

7. The method of claim 1, wherein the recording layer includes an infrared ray absorbing agent.

8. A method of manufacturing a planographic printing plate for use in recording by an infrared ray laser, comprising the steps of:

(a) providing a support;

(b) forming a plurality of primer layers on the support by applying a coating solution to the support a plurality of times, wherein a total amount of material comprising the primer layers after drying is 2 to 200 mg/m$^2$; and (c) superposing a recording layer on a primer layer that was formed last.

9. The method of claim 8, wherein the recording layer includes a water-insoluble and alkaline water-soluble polymer.

10. A planographic printing plate comprising:

(a) a support;

(b) a recording layer; and (c) a plurality of primer layers disposed between the support and the recording layer, wherein the primer layers comprise coatings of a coating solution, and wherein the plurality of primer layers are formed by applying a coating solution once to form one primer layer, and applying the coating solution again, to form another primer layer, wherein an interval of time between successive applications of the coating solution is 0.1 to 15 seconds and wherein the primer layers all together comprise a total amount of dried coating solution of 2 to 200 mg/m$^2$.

11. The planographic printing plate of claim 10, wherein the primer layers comprise 2 to 4 coatings of said coating solution.

12. The planographic printing plate of claim 10, wherein the recording layer includes an infrared ray absorbing agent.

13. A planographic printing plate comprising:

(a) a support;

(b) a recording layer which includes a water-insoluble and alkaline water-soluble polymer; and (c) a plurality of primer layers disposed between the support and the recording layer, wherein the primer layers comprise coatings of a coating solution, and wherein the plurality of primer layers are formed by applying a coating solution once to form one primer layer, and applying the coating solution again, to form another primer layer, wherein an interval of time between successive applications of the coating solution is 0.1 to 15 seconds.

14. The planographic printing plate of claim 13, wherein the primer layers comprise 2 to 4 coatings of said coating solution.

15. The planographic printing plate of claim 14, wherein the primer layers all together comprise a total amount of dried coating solution of 2 to 200 m/$^2$.

16. The planographic printing plate of claim 15, wherein the recording layer includes an infrared ray absorbing agent.

17. A planographic printing plate comprising:

(a) a support wherein the support comprises aluminum;

(b) a recording layer; and (c) a plurality of primer layers disposed between the support and the recording layer, wherein the primer layers comprise coatings of a coating solution, and wherein the plurality of primer layers are formed by applying a coating solution once to form one primer layer, and applying the coating solution again, to form another primer layer, wherein an interval of time between successive applications of the coating solution is 0.1 to 15 seconds.

* * * * *